US012343589B1

(12) United States Patent
Bishop et al.

(10) Patent No.: US 12,343,589 B1
(45) Date of Patent: Jul. 1, 2025

(54) TREADMILL WITH CALIBRATED AIRFLOW

(71) Applicants: Daniel Bishop, Madison, AL (US); Phillip Bishop, Northport, AL (US)

(72) Inventors: Daniel Bishop, Madison, AL (US); Phillip Bishop, Northport, AL (US)

( * ) Notice: Subject to any disclaimer, the term of this patent is extended or adjusted under 35 U.S.C. 154(b) by 113 days.

(21) Appl. No.: 18/111,425

(22) Filed: Feb. 17, 2023

(51) Int. Cl.
*A63B 22/02* (2006.01)

(52) U.S. Cl.
CPC ..... *A63B 22/0242* (2013.01); *A63B 2225/01* (2013.01); *A63B 2225/52* (2013.01)

(58) Field of Classification Search
CPC ..... A63B 22/0242; A63B 2225/01; A63B 2225/52; A63B 22/025; A63B 71/0054; A63B 21/4035; A63B 24/0087; A63B 2225/74; A63B 2230/208; A63B 2230/505; A63B 21/005; A63B 21/008; A63B 21/0085; A63B 22/0023; A63B 24/0059; A63B 2024/009; A63B 2071/0072; A63B 2071/0081; A63B 2071/0658; A63B 2071/0694; A63B 2220/53; A63B 2220/805; A63B 2225/09; A63B 2225/093; A63B 2225/685; A63B 2230/062; A63B 69/0057; A63B 2071/0625; A63B 2071/063; A63B 2071/0647; A63B 2071/0655; A63B 2220/13; A63B 2220/18; A63B 2220/30; A63B 2220/40; A63B 2220/803; A63B 2230/75; A63B 2071/0063; A63B 2220/56; A63B 2225/682; A63B 2230/06; A63B 22/0285; A63B 71/0622; A63B 2024/0093; A63B 2071/0691; A63B 2220/22; A63B 2225/50; A63B 2230/04; A63B 2230/207; A63B 2230/42; A63B 2230/50
See application file for complete search history.

(56) References Cited

U.S. PATENT DOCUMENTS 4,580,983 A * 4/1986 Cassini ..... G09B 9/058 482/61
4,589,656 A 5/1986 Baldwin
(Continued)

FOREIGN PATENT DOCUMENTS

CN 208405895 U 1/2019
GB 2409651 A 6/2005
(Continued)

OTHER PUBLICATIONS

Wahoo KICKRHeadwind Quick Start Guide, accessed from website www.wahoofitness.com on Feb. 1, 2023.

*Primary Examiner* — Garrett K Atkinson
(74) *Attorney, Agent, or Firm* — AdamsIP, LLC; Stephen Thompson; J. Hunter Adams

(57) ABSTRACT

A treadmill with a fan that directs an airflow toward a user is provided. A fan controller receives an input signal corresponding to a belt speed of the treadmill belt and converts the input signal into an output signal to the fan to control the speed of the airflow by adjusting the rotational speed of the fan. The fan controller is calibrated to adjust the fan speed so that the air speed experienced by the user matches the belt speed, thereby accurately simulating the airflow and air resistance that the user would experience when running over ground at the same speed that the treadmill belt is moving.

19 Claims, 6 Drawing Sheets

(56) References Cited

U.S. PATENT DOCUMENTS 5,102,380 A 4/1992 Jacobson et al.
5,240,417 A 8/1993 Smithson et al.
5,665,032 A 9/1997 Chen
5,897,460 A * 4/1999 McBride ..... A63B 22/02 482/54
6,300,694 B1 * 10/2001 Wang ..... F04D 25/082 310/63
6,478,720 B1 * 11/2002 Barker ..... A63B 22/0235 482/54
6,800,050 B2 10/2004 Moavro et al.
6,878,099 B2 * 4/2005 Corbalis ..... A63B 24/00 482/54
6,960,156 B2 11/2005 Smith
7,585,251 B2 * 9/2009 Doody, Jr. ..... A63B 22/0605 482/9
7,887,466 B1 2/2011 Chen
7,976,434 B2 7/2011 Radow
8,920,288 B2 * 12/2014 Dalebout ..... A63B 24/0062 482/4
10,391,361 B2 8/2019 Watterson
11,048,776 B2 6/2021 Snaterse et al.
11,130,015 B2 9/2021 Chen
11,161,003 B2 11/2021 Donner et al.
2002/0137601 A1 * 9/2002 Tobias ..... A63B 21/00069 482/52
2004/0018917 A1 * 1/2004 Corbalis ..... A63B 24/00 482/57
2004/0097341 A1 5/2004 Alessandri et al.
2010/0227542 A1 * 9/2010 Goldmann ..... F24F 1/022 454/258
2011/0065371 A1 * 3/2011 Leff ..... F24F 1/0011 454/237
2012/0237911 A1 * 9/2012 Watterson ..... G10L 15/26 482/4
2012/0322621 A1 12/2012 Bingham, Jr. et al.
2013/0035208 A1 * 2/2013 Dalebout ..... A63B 22/02 482/8
2013/0165195 A1 * 6/2013 Watterson ..... A63B 24/0084 463/6
2013/0178334 A1 * 7/2013 Brammer ..... A63B 71/0622 482/4
2013/0178337 A1 * 7/2013 Brammer ..... A63B 22/02 482/9
2013/0267383 A1 10/2013 Watterson
2013/0274067 A1 10/2013 Watterson et al.
2016/0213976 A1 * 7/2016 So ..... A63B 71/0622
2021/0106899 A1 * 4/2021 Willardson ..... A63B 21/154
2022/0080265 A1 3/2022 Watterson et al.
2022/0339493 A1 * 10/2022 Larsen ..... A63B 24/0087

FOREIGN PATENT DOCUMENTS

KR 200368293 Y1 11/2004
WO 03084614 A2 10/2003

* cited by examiner

TREADMILL WITH CALIBRATED AIRFLOW

FIELD OF THE INVENTION

The present disclosure relates generally to a treadmill having one or more fans that are calibrated to accurately simulate an outdoor running condition for a user.

BACKGROUND

Treadmills are a commonly used type of exercise equipment for use both at home and at gyms. A treadmill belt speed can be increased or decreased to vary the intensity of the exercise between a slow walking speed and full running speed. To help keep users cool, some treadmills, as well as other types of exercise equipment, such as stationary bikes and elliptical machines, include a fan that blows air onto the user while the user is walking or running on the treadmill. The fan may have independent controls so that the user can set the fan speed to any desired speed. In other cases, the fan speed may be dependent upon some other type of input, such as the motion of the user in the process of using the equipment for exercise. For example, some stationary bikes have fans that are powered by the user's pedaling motion so that the fan speed increases as the user pedals faster. In other cases, the fan speed may be dependent on some physiological condition of the user as the user performs an exercise, such as the user's heart rate. Such equipment may be paired with a sensor such as a heart rate monitor, which may communicate with the exercise equipment using Bluetooth or a similar wireless communication technology.

Other advancements in exercise equipment technology have been directed toward simulating real-world conditions by altering certain operating parameters of the equipment. Such simulations may be able to simulate actual real-world locations such as well known running or biking trails. For instance, to simulate the topography of a real-world location, some treadmills have the ability to tilt the deck to increase and decrease the slope of the running surface as the user works through a programmed simulation. Similarly, some stationary bikes and elliptical machines, as well as some motorless treadmills, have the ability to increase the resistance of the moving parts of the machine to simulate an increase in the slope of the terrain. Mechanical resistance may also be used to simulate other conditions, such as air resistance due to the movement of a user through the air, which may be increased in the case of a headwind, but mechanical resistance alone cannot provide a realistic experience for the user if the user cannot feel the air resistance. However, known exercise equipment having fans or various mechanisms for simulating real-world conditions are generally not effective at accurately simulating what a user would experience when actually running at a certain speed through the air. In the case of stationary bikes and elliptical machines, because the user is physically anchored to the equipment when using the equipment, airflow from a fan may provide a more pleasant experience but does not provide effective resistance that increases workload due to air resistance. Thus, fans used for stationary bikes, elliptical machines, and other similar types of exercise equipment are not generally effective at realistically simulating a user experience. In the case of a treadmill, the user is not anchored to the machine but instead runs freely on the moving belt. Thus, on a treadmill air resistance can have a meaningful effect on the user's experience as the user feels the resistance of the air moving around the user's body and must work harder to overcome the resistance. Thus, it would be desirable for a treadmill to provide an accurate and realistic simulation of air resistance for a user.

Accordingly, there exists a need in the art for a treadmill with a calibrated blower unit that is capable of accurately simulating air resistance that would be experienced by a runner in real-world conditions.

SUMMARY

In one aspect, a treadmill with a calibrated blower unit and a method of using the blower unit to control the speed of an airflow experienced by a user are provided. The treadmill comprises a deck designed to support a user at a position on the deck and an endless belt that moves relative to the deck so that the user may walk or run at the same speed as the belt. The treadmill includes a motor configured to drive motion of the belt at a defined speed and a speed controller configured to control the belt speed. At least one fan is mounted onto the treadmill and is configured to direct an airflow at an air speed in a direction toward the user position. The treadmill further comprises a speed control signal monitor and a fan controller in communication with the speed control signal monitor and with the fan. The speed control signal monitor is configured to read a control signal that corresponds to the belt speed. In one embodiment, the control signal may be an input signal to the speed controller from a user interface control board or a feedback signal from the speed controller to the user interface control board. The fan controller is configured to control the air speed by adjusting a rotational speed of the fan based on the control signal read by the speed control signal monitor. Further, the fan controller is calibrated to adjust the rotational speed of the fan based on the control signal so that the air speed at the user position substantially matches the belt speed of the endless belt. The fan controller may be configured to automatically adjust the rotational speed of the fan in response to changes in the belt speed if the user changes the belt speed while using the treadmill. Because the fan is calibrated to match the air speed to any given belt speed, the present treadmill is capable of accurately simulating air resistance that would be experienced by a user running in real-world conditions.

In a preferred embodiment, the treadmill comprises a motor bay and a control console comprising a user interface that is operably connected to the user interface control board, which communicates with the speed controller to allow user control of the belt speed. The motor is housed within the motor bay and is positioned at one end of the endless belt. Preferably, the control console is positioned vertically higher than the motor bay and the endless belt, preferably at a height that is generally between a waist height and a chest height of a user of average height. The speed controller may be housed within the motor bay and may be operably connected to the user interface control board by a mast cable that is disposed within a vertical support that attaches the control console to the deck. In a preferred embodiment, the fan is mounted in a position vertically between the control console and the endless belt so that the fan generally directs air toward the lower body of the user. The treadmill preferably includes a second fan that is mounted in a position vertically higher than the control console so that the second fan generally directs air toward the upper body of the user. Thus, the combination of fans may generally direct air over substantially all areas of the user's body.

In another embodiment, the control console is attached to the deck by two vertical supports disposed on opposite sides of the deck, and the fan comprises four blower units arranged in two columns on opposite sides of the deck. In this embodiment, two of the blower units may each be mounted onto a respective one of the vertical supports in a position vertically between the control console and the endless belt, and the other two blower units may each be mounted in a position vertically higher than the control console. Thus, this combination also generally directs air over substantially all areas of the user's body, but may allow for greater forward visibility for the user by leaving an open area over the control console between the two columns of blower units.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
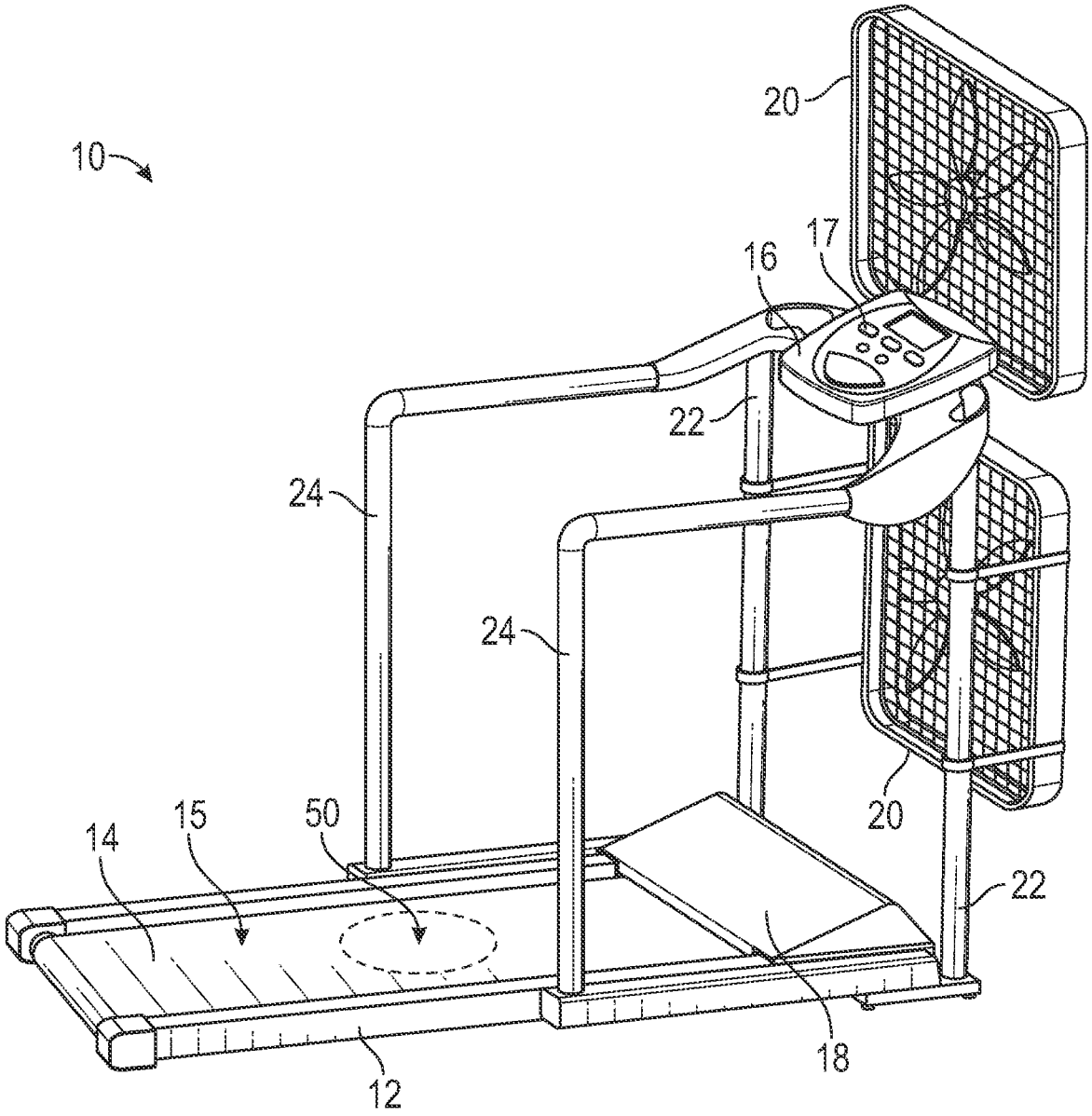
FIG. 1 shows a perspective view of a treadmill in accordance with the present disclosure.
Figure 2:
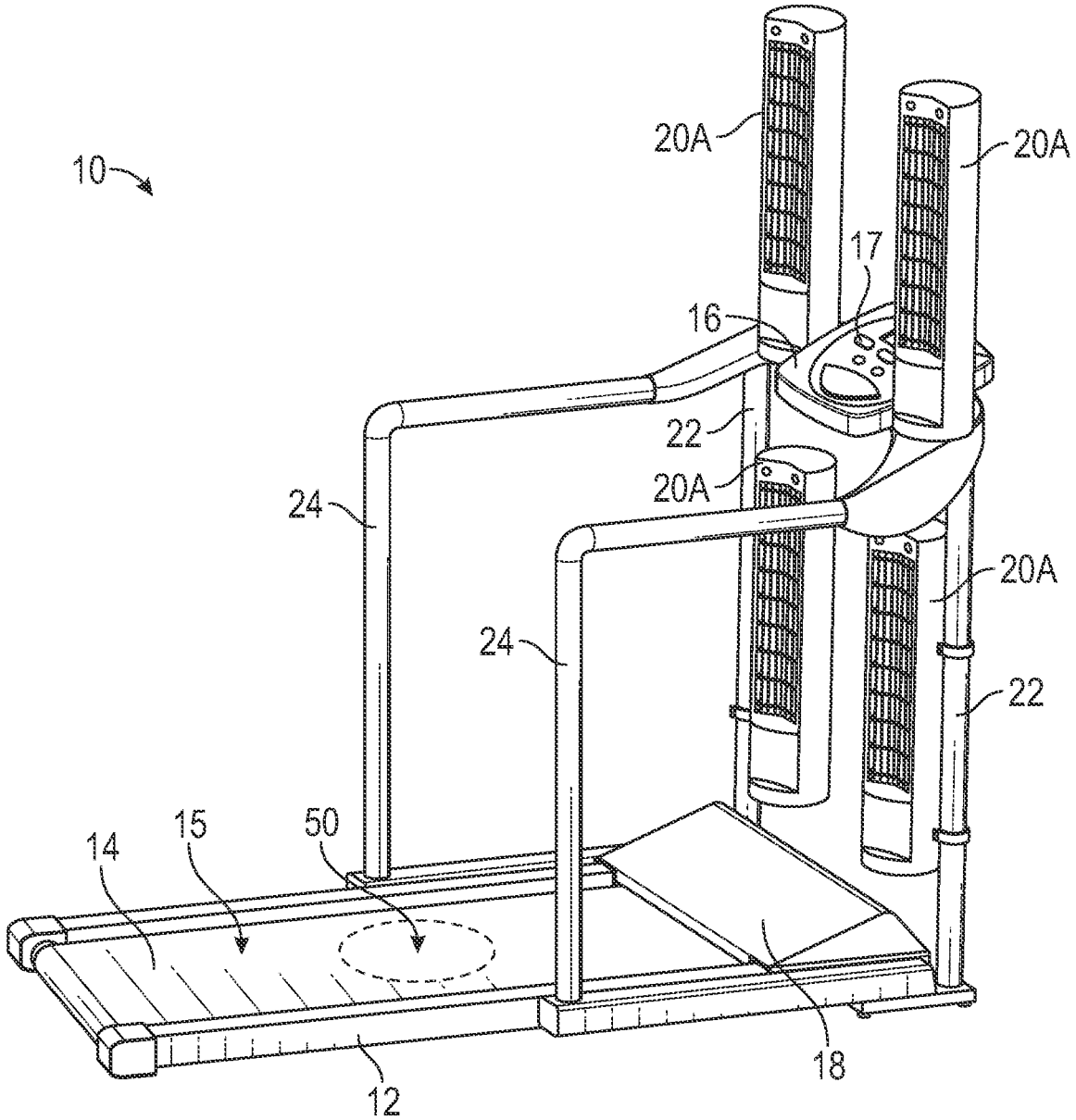
FIG. 2 shows a perspective view of an alternative embodiment of a treadmill in accordance with the present disclosure.
Figure 3:
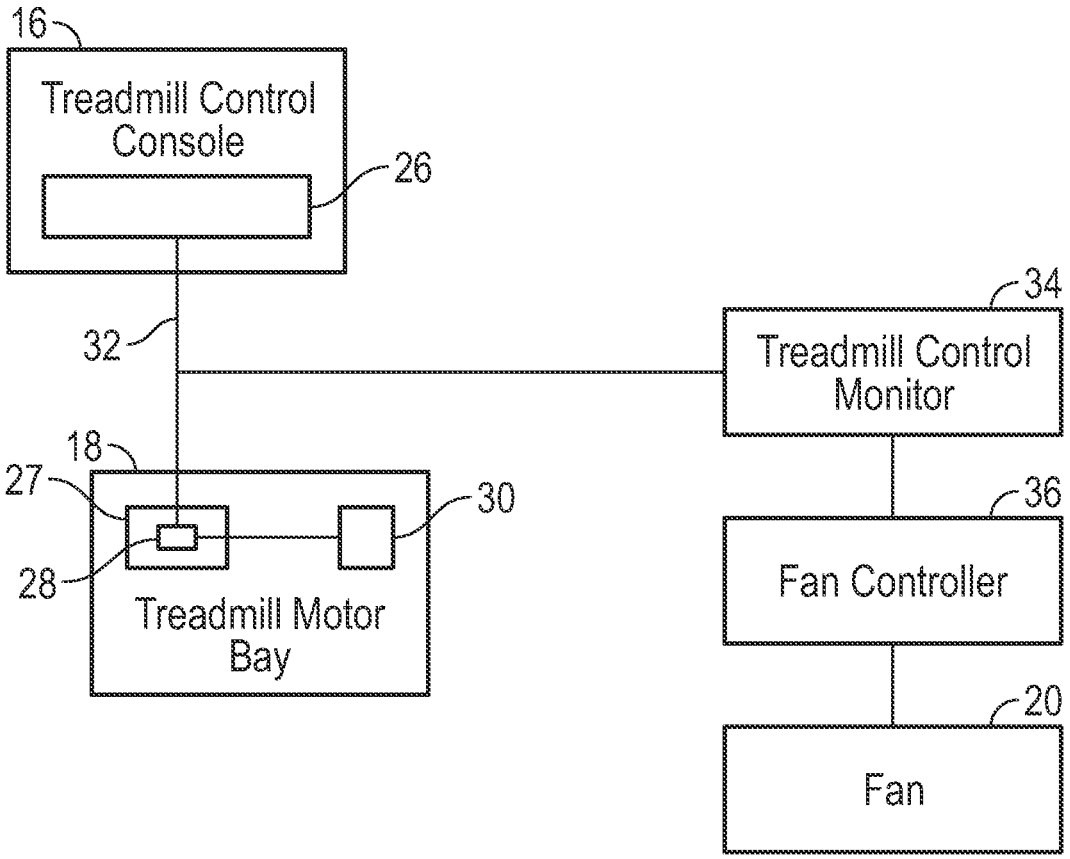
FIG. 3 shows a schematic view of components of a treadmill in accordance with the present disclosure.

In one aspect, a treadmill 10 with a calibrated fan 20 is provided. FIGS. 1-3 illustrate preferred embodiments of the treadmill 10. The fan 20 may be used to control an air speed of an airflow directed toward a user when using the treadmill 10 so that the air speed experienced by the user substantially matches a belt speed of the treadmill. This allows the present treadmill 10 to provide air resistance, as well as cooling, that accurately simulates the experience that would be felt by the user under real-world conditions as the user walked or ran over a ground surface at a walking or running speed. In a preferred embodiment, the fan 20 is calibrated to simulate air resistance that the user would experience if the user were running under conditions of no wind or other air movement. In this embodiment, the air speed produced by the fan 20 at the position of the user on the treadmill 10 is calibrated to substantially match the speed of the belt 14, which correlates directly to the speed that the user would be moving when walking or running in real-world conditions. In many overground running scenarios, runners generally start and finish at approximately the same geographical point, which under real-world wind conditions likely results in an additive net wind that generally cancels itself. Thus, as long as there are no significant changes in wind speed and direction over the course of a run, this results in a net wind that is generally close to zero for a complete running session. In this case, the user experience can be accurately simulated by substantially matching the air speed produced by the fan 20 at the position of the user on the treadmill 10 to the speed of the belt 14, which accounts for the net effects of headwinds and tailwinds that may be experienced at different points during a run. In alternative embodiments, the air speed produced by the fan 20 at the position of the user on the treadmill 10 may be calibrated to simulate a headwind by producing an air speed experienced by the user that is greater than the belt speed by a differential that is equal to the air speed of the headwind. Similarly, the fan 20 may also be calibrated to simulate a tailwind by producing an air speed that is lower than the belt speed.

The treadmill 10 comprises a deck 12 designed to support a user and an endless belt 14 having an upper surface 15 that moves relative to the deck 12. The deck 12 supports the user's body weight while the user is running or walking on the upper surface 15 of the belt 14 at a user position 50 on the deck 12. The user position 50 is generally defined by the area where the user would normally be positioned when walking or running on the treadmill 10 and is indicated generally by the dashed lines as shown on the upper surface 15 of the belt 14 in FIGS. 1 and 2. The user position 50 extends vertically upward from this general area to a height of the user and thus generally refers to the position in which the user's body will be when using the treadmill 10. The user position 50 is the location at which air speed is measured for calibration purposes so that the fan 20 accurately produces an air speed that would be experienced by the user under real-world conditions. In a preferred embodiment, the air speed may be measured at the user position 50 at a distance from the fan 20 that is approximately equal to the shortest distance from the fan 20 to a vertical plane that is perpendicular to the direction of the movement of the belt 14 and that is positioned generally at the point of the user's torso that is nearest to the fan 20. It should be understood that this location of measurement of air speed is an approximation as the distance between the fan 20 and the user's torso may vary slightly depending on the individual user and where the user is positioned during a given treadmill session.

The treadmill 10 comprises a motor 30 configured to drive motion of the endless belt 14 at a defined belt speed and a speed controller 28 configured to control the belt speed. At least one fan 20 is mounted onto the treadmill 10 and is configured to direct an airflow at an air speed in a direction toward the user position 50. In a preferred embodiment, the belt motor 30 is housed within a motor bay 18 and is positioned at one end of the endless belt 14. The motor 30 is preferably an electric motor that drives a roller that is operably connected to the belt 14 to drive motion of the belt. A second roller may be disposed at an opposite end of the belt 14 to form a continuous loop. The motor bay 18 may optionally house a second motor configured to move the deck 12 to change the incline for simulating a topographical change. The treadmill 10 preferably further comprises a control console 16 positioned vertically higher than the motor bay 18 and the endless belt 14, as shown in FIGS. 1 and 2. The control console 16 comprises a user interface 17 that is operably connected to a user interface control board 26 that communicates with the speed controller 28 to allow user control of the belt speed. Preferably, the control console 16 is positioned vertically at a height that is generally between a waist height and a chest height of a user of average height. In a preferred embodiment, the control console 16 is attached to the deck 12 by two vertical supports 22 disposed on opposite sides of the deck 12. A pair of opposing handlebars 24 may also be attached to the control console 16 and/or to the vertical supports 22 to provide handles on either side of the belt 14 for the user to hold for support and stability while using the treadmill 10.

FIGS. 1 and 2 show example embodiments of fan 20 configurations that may be utilized, though it should be understood by one of skill in the art that other fan configurations are possible and would still fall within the scope of the present disclosure. One or more fans 20 are preferably positioned relative to the user to provide an airflow over substantially all of the user's body when occupying the user position 50. In a preferred embodiment, as shown in FIG. 1, a first fan 20 is mounted in a position vertically between the control console 16 and the endless belt 14 so that the fan 20 generally directs air toward the lower body of the user. The treadmill 10 preferably includes a second fan 20 that is mounted in a position vertically higher than the control console 16 so that the second fan 20 generally directs air toward the upper body of the user. Thus, a combination of multiple fans 20 may generally direct air over substantially all areas of the user's body. In an alternative embodiment, as shown in FIG. 2, the fan 20 comprises four blower units 20A arranged in two columns on opposite sides of the deck 12. Each blower unit 20A preferably comprises a column, which may comprise multiple individual fan blades housed inside the column so that a column of air is directed toward the user from each unit 20A. In this embodiment, two of the blower units 20A are preferably each mounted onto a respective one of the vertical supports 22 in a position vertically between the control console 16 and the endless belt 14, and the other two blower units 20A are preferably each mounted in a position vertically higher than the control console 16. Thus, this combination of blower units 20A also generally directs air over substantially all areas of the user's body, but may allow for greater forward visibility for the user by leaving an open area over the control console 16 between the two columns of blower units 20A.

The treadmill 10 further comprises a speed control signal monitor 34 and a fan controller 36 in communication with the speed control signal monitor 34 and with the fan 20. The speed control signal monitor 34 is configured to read a control signal that corresponds to the belt speed. In one embodiment, the control signal may be an input signal to the speed controller 28 from the user interface control board 26 or a feedback signal from the speed controller 28 to the user interface control board 26 indicating the belt speed. Thus, the speed control signal monitor 34 may read the input signal to the speed controller 28 from the user interface control board 26 that is based on a speed setting entered by a user to set the speed of the belt 14.

Alternatively, the speed control signal monitor 34 may read a feedback signal from the speed controller 28 to the user interface control board 26 that communicates the current belt speed to the user interface control board 26, which is typically displayed to the user on a screen on the user interface 17. The fan controller 36 may communicate with the speed control signal monitor 34 and/or with the fan 20 via a wired or wireless connection.

The fan controller 36 is configured to control the air speed by adjusting a rotational speed of the fan 20 based on the control signal read by the speed control signal monitor 34. In a preferred embodiment, the user interface control board 26 is housed within the control console 16, and the speed controller 28 is housed within the motor bay 18, as shown in FIG. 3. In this embodiment, the speed controller 28 may be operably connected to the user interface control board 26 by a mast cable 32 that is disposed within one of the vertical supports 22 that attaches the control console 16 to the deck 12. In a preferred embodiment, the speed control signal monitor 34 may comprise a pass-through device connected to the mast cable 32 and configured to read the control signal between the speed controller 28 and the user interface control board 26. The speed controller 28 may be a separate component or may optionally be incorporated into a lower control board 27 disposed within the motor bay 18 that controls the belt speed, as well as other features of the treadmill 10, such as a separate optional motor for adjusting the incline of the belt 14. The speed control signal monitor 34 allows all signals to pass freely between the user interface control board 26 and the lower control board 27, but reads the belt speed control signal. Thus, as the belt speed control signal passes between the speed controller 28 and the user interface control board 26 the speed control signal monitor 34 may read the control signal without affecting operation of the speed controller 28 and communicate belt speed data to the fan controller 36. Alternatively, the speed control signal monitor 34 may read the control signal via a wired or wireless connection with the user interface control board 26 and/or the speed controller 28.

The speed control signal monitor 34, the fan controller 36, and the fan 20 may be retrofitted to an existing treadmill or may be installed during the manufacturing of the treadmill, preferably within the control console 16 or the motor bay 18. In one embodiment, a standalone device for controlling the speed of a fan 20 on a treadmill 10 is provided. The device comprises a speed control signal monitor 34 and a fan controller 36. The device is configured to communicate with a control system of an existing treadmill, which may include a user interface control board 26 and/or a speed controller 28, so that the speed control signal monitor 34 can read a control signal corresponding to a belt speed of the treadmill. The device may be plugged into the control system of the treadmill so that the speed control signal monitor 34 can read the control signal. Alternatively, the device may be configured for a user to set up the device so that the speed control signal monitor 34 can communicate wirelessly with the treadmill control system via Bluetooth or a similar wireless communication technology to read the control signal. The fan controller 36 is configured to communicate with the speed control signal monitor 34 and to control a rotational speed of a fan 20 based on the control signal read by the speed control signal monitor 34. The device may include the fan 20 or may be connected to an existing fan 20 installed on a treadmill via either a wired or wireless connection. The fan 20 is preferably mounted onto the treadmill 10 but may alternatively be separate from the treadmill, in which case the fan controller 36 may be calibrated for a fan 20 positioned at a specified distance from the user position 50.

The fan controller 36 is calibrated to adjust the rotational speed of the fan 20 based on the control signal so that the air speed at the user position 50 substantially matches the belt speed of the endless belt 14. Because the airflow from the fan 20 may be turbulent and thus have variations in measured air speed at a particular location, the fan controller 36 may be calibrated so that average air speed at the user position 50 is within a certain defined tolerance level of the belt speed. In addition, if the belt speed changes there may be a lag time for adjusting the rotational speed of the fan 20 to match the air speed to the belt speed. One of skill in the art would appreciate that in such instances the air speed would be considered to substantially match the belt speed. To calibrate the fan controller 36, an air speed may be measured at the user position 50 and correlated to a fan control frequency for a fan motor at a speed setting that achieves the measured air speed, and a linear belt speed may be measured and correlated to a belt speed control signal. This process may be repeated for different belt speeds with corresponding fan speeds that produce an air speed approximating the given belt speed.

An example calibration was performed on a commercially available treadmill. To calibrate the fan controller 36, the speed control signal monitor 34 was wired to the mast cable 32 of the treadmill. A commercially available fan 20 was modified to replace its AC (alternating current) motor with a DC (direct current) motor and then mounted onto the treadmill and wired to the fan controller 28 and speed control signal monitor 34. Table 1 below shows the calibration data obtained. It should be understood by one of skill in the art that Table 1 shows example data obtained for a specific treadmill and fan and that such data may be different for other types of treadmills and fan combinations, depending on the specifications of certain components of the treadmill and the fan, such as the belt drive motor 30, the fan 20 motor, the fan controller 36, and the distance between the mounted fan 20 and the user position 50.

TABLE 1

| Calibration Data<br>Calibration Data | | | |
|---|---|---|---|
| Belt Speed (mph) | Feedback Duty Cycle (percent) | Fan Control Frequency (Hz) | Air Speed at User (mph) |
| 2 | 24 | 75 | 2 |
| 3 | 34 | 85 | 3 |
| 4 | 41 | 105 | 4 |
| 5 | 48 | 129 | 5 |
| 6 | 55 | 160 | 6 |
| 7 | 60 | 200 | 7 |
| 8 | 65 | 240 | 8 |

Figure 5:
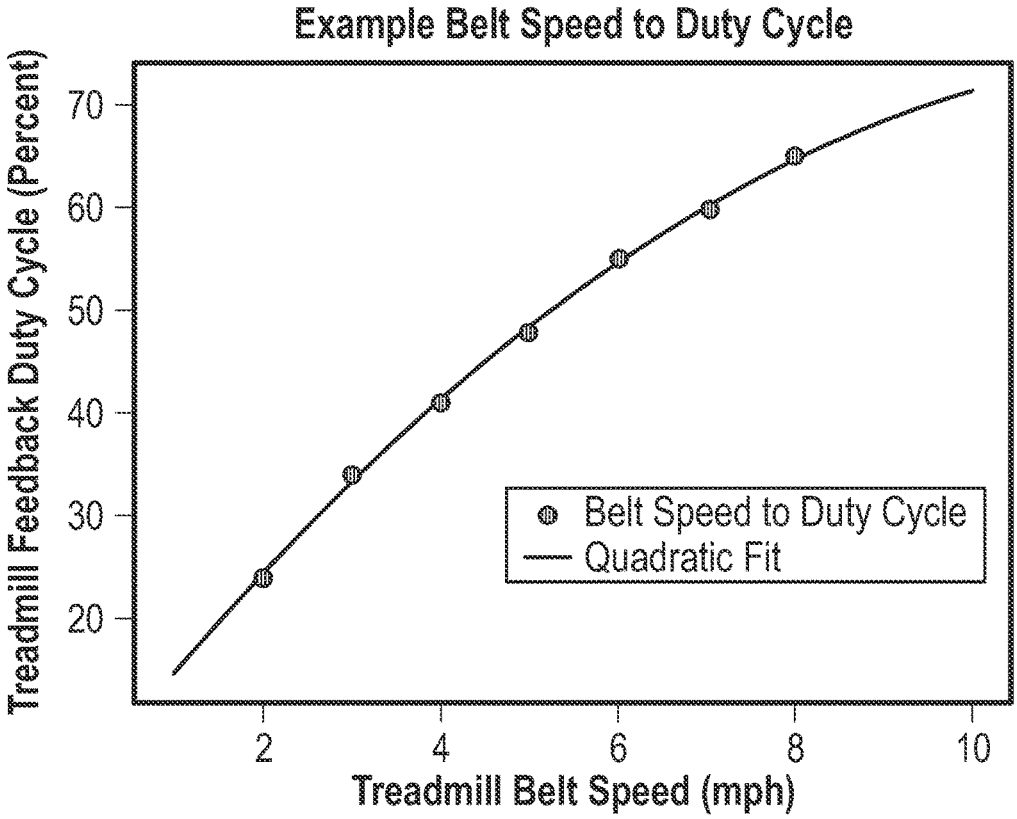
FIG. 5 shows an example curve charting belt speed versus duty cycle for a treadmill motor in accordance with the present disclosure.
Figure 6:
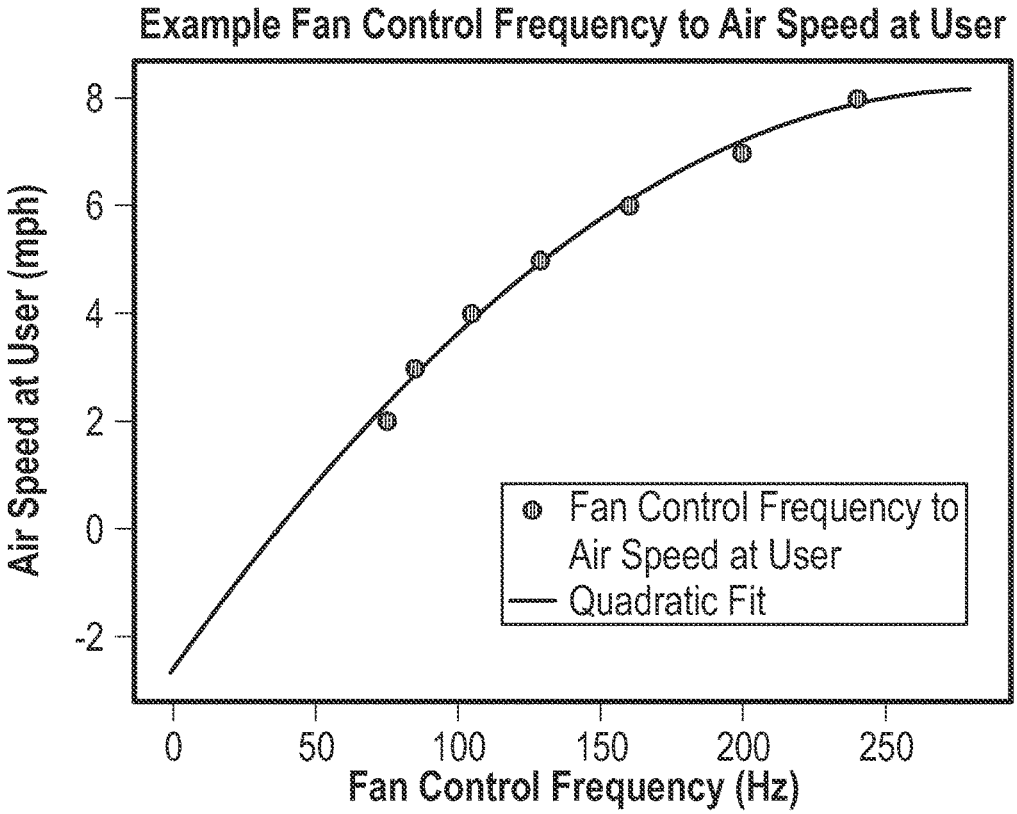
FIG. 6 shows an example curve charting air speed versus fan control frequency for a treadmill fan in accordance with the present disclosure.

The belt speed of the treadmill utilized was pre-calibrated to match a speed displayed on the user interface based on user input. The belt speed may also be obtained directly by utilizing a speed sensor. At each belt speed used for the calibration, the feedback duty cycle was detected using the speed control signal monitor 34 to read a pulse-width modulated (PWM) signal used for controlling the belt speed of the treadmill. FIG. 5 shows a quadratic regression curve modeling the relationship between belt speed and feedback duty cycle for the treadmill utilized. In a preferred embodiment, the fan controller 36 comprises a power supply and a microcontroller used to control the DC motor in the fan 20. To perform the calibration, an anemometer was used to measure air speed at the user position 50, and at each air speed the microcontroller received the PWM control signal and converted it to a frequency modulated (FM) signal to control the DC motor of the fan 20. FIG. 6 shows a quadratic regression curve modeling the relationship between air speed at the user position and fan control frequency for the fan utilized at the distance from the user position at which the fan was mounted.

Figure 7:
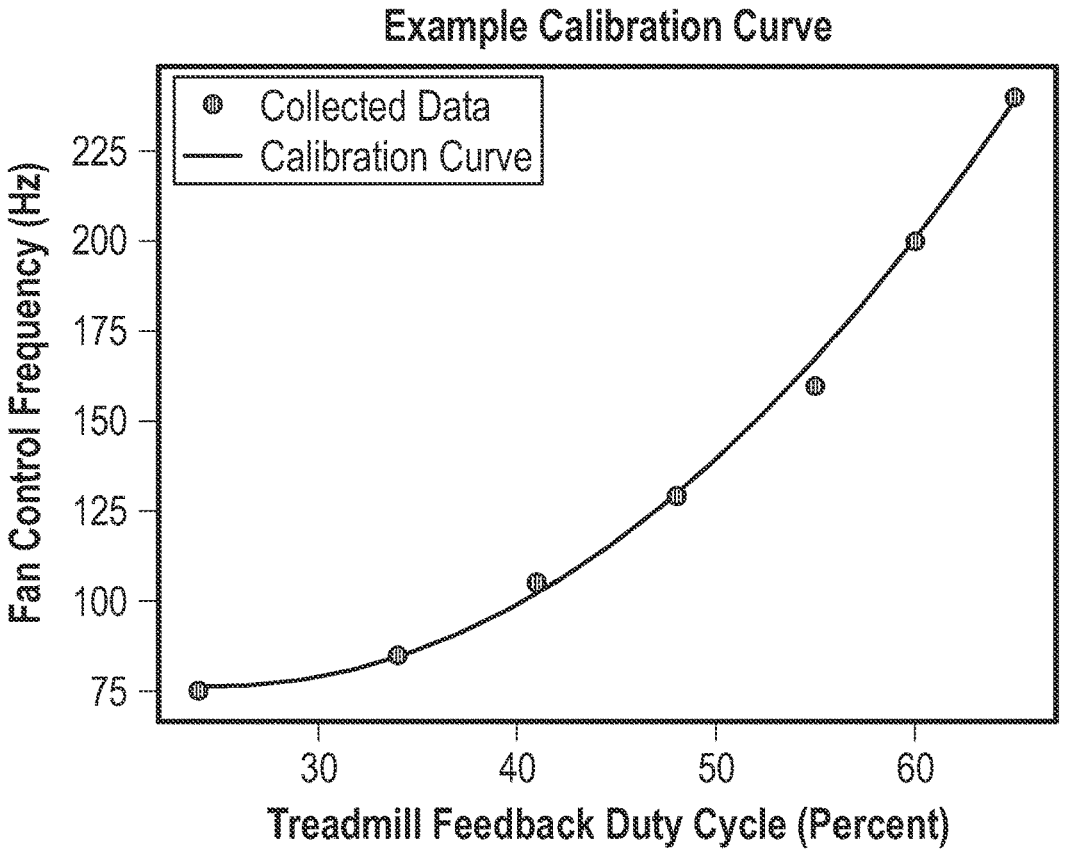
FIG. 7 shows an example calibration curve used for calibrating a fan speed controller of a treadmill in accordance with the present disclosure.

The data obtained were utilized to produce the calibration curve shown in FIG. 7, which is a quadratic regression curve modeling the relationship between feedback duty cycle and fan control frequency for the treadmill and fan utilized in the example calibration method. Using this example calibration curve, the fan 20 motor may be controlled to produce a corresponding air speed at the user position 50 based on a desired belt speed setting. The fan controller 36 may be configured to automatically adjust the rotational speed of the fan 20 in response to updated belt speed data communicated by the speed control signal monitor 34 based on changes to the belt speed input by the user via the user interface 17. Because the fan 20 is calibrated to match the air speed to any given belt speed, the present treadmill 10 is capable of accurately simulating wind resistance as it would be experienced by a user in real-world conditions. The method may be utilized for multiple fans 20 mounted onto the treadmill 10, all of which may be controlled simultaneously utilizing a single speed control signal monitor 34 and fan controller 36.

Figure 8:
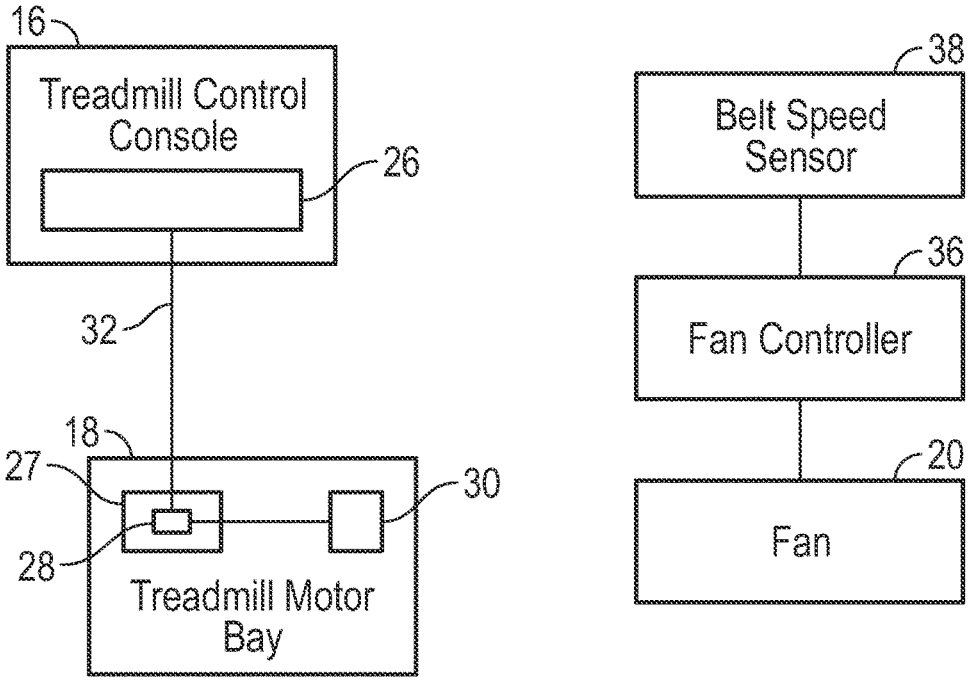
FIG. 8 shows a schematic view of components of a treadmill in accordance with the present disclosure.

FIG. 8 shows a schematic for an alternative embodiment utilizing a belt speed sensor 38 that is configured to directly measure the speed of the belt 14. In a preferred embodiment, the speed sensor 38 is an optical speed sensor or a mechanical speed sensor that is mounted in a location on the treadmill 10 in which the speed sensor 38 can directly measure a linear speed of the belt 14. In this embodiment, the fan controller 36 is in communication with the belt speed sensor 38 and with the fan 20, and the fan controller 36 is configured to control the air speed by adjusting a rotational speed of the fan 20 based on an input signal from the belt speed sensor 38. The fan controller 36 is calibrated to adjust the rotational speed of the fan 20 based on the input signal from the speed sensor 38 so that the air speed at the user position 50 substantially matches the belt speed. As shown in FIG. 8, because the belt speed sensor 38 can measure the belt speed directly, the sensor 38 can be installed independently of the speed controller 28 for the belt drive motor 30. If the belt speed changes, the speed sensor 38 can detect the change in speed and adjust the input signal to the fan controller 36 accordingly to maintain a synchronous air speed and belt speed.

Figure 4:
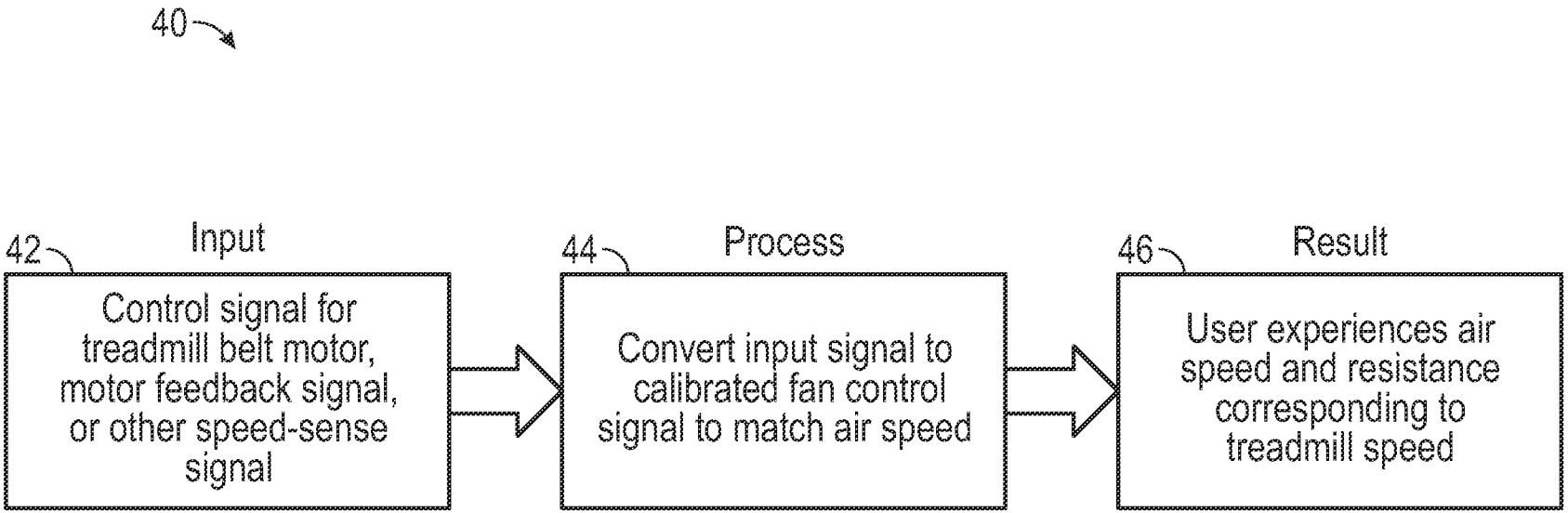
FIG. 4 shows a block diagram of a method for controlling the speed of a treadmill fan in accordance with the present disclosure.

In another aspect, as shown in FIG. 4, a method 40 for controlling the speed of a fan 20 on a treadmill 10 is provided. Step 42 provides an input correlated to the speed of the belt 14. In this step 42, the speed signal control monitor 34 reads a control signal that corresponds to the belt speed, or the belt speed sensor 38 directly detects the belt speed. This provides an input signal that is processed in step 44. In this step 44, the control signal, or input signal to the fan controller 36, is converted into a calibrated output signal from the fan controller 36 to the fan 20, and the rotational speed of the fan 20 is adjusted with the fan controller 36 to substantially match the air speed at the user position 50 to the belt speed. The control signal is converted into the output signal based on the calibration of the fan controller 20. In step 46, the user experiences the end result, which is to experience the same air speed and air resistance that the user would experience if running over a ground surface at the same speed as the speed the belt 14 is moving.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A treadmill comprising:

a deck designed to support a user at a user position;

an endless belt having an upper surface that moves relative to the deck;

a motor configured to drive motion of the endless belt at an adjustable belt speed;

a speed controller configured to control the adjustable belt speed of the endless belt;

a user interface control board configured to communicate with the speed controller to allow user control of the adjustable belt speed;

a fan mounted onto the treadmill, wherein the fan is configured to direct an airflow at an air speed in a direction toward the user position;

a speed control signal monitor that reads a control signal corresponding to a defined belt speed, wherein the control signal is an input signal to the speed controller from the user interface control board or a feedback signal from the speed controller to the user interface control board, wherein the speed control signal monitor is configured to read the control signal passing between the speed controller and the user interface control board in a pass-through manner;

a fan controller in communication with the speed control signal monitor and with the fan, wherein the fan controller is configured to control the air speed by adjusting a rotational speed of the fan in response to the control signal read by the speed control signal monitor such that the air speed at the user position is substantially synchronized with the defined belt speed on a unit-to-unit basis.

2. The treadmill of claim 1, wherein the fan controller is configured to automatically adjust the rotational speed of the fan in response to changes in the defined belt speed during use of the treadmill.

3. The treadmill of claim 1, wherein the motor is housed within a motor bay and is positioned at one end of the endless belt, wherein the treadmill further comprises a control console positioned vertically higher than the motor bay, wherein the control console comprises a user interface that is operably connected to the user interface control board.

4. The treadmill of claim 3, wherein the user interface control board is housed within the control console, wherein the speed controller is housed within the motor bay and is operably connected to the user interface control board by a mast cable that is disposed within a vertical support that attaches the control console to the deck, wherein the pass-through device is wired to the mast cable and configured to read the control signal passing between the speed controller and the user interface control board via the mast cable.

5. The treadmill of claim 1, wherein the treadmill comprises a control console positioned vertically higher than the endless belt, wherein the fan is mounted in a position vertically between the control console and the endless belt.

6. The treadmill of claim 5, wherein the treadmill further comprises a second fan mounted in a position vertically higher than the control console.

7. The treadmill of claim 1, wherein the treadmill comprises a control console positioned vertically higher than the endless belt, wherein the control console is attached to the deck by two vertical supports disposed on opposite sides of the deck, wherein the fan comprises four blower units arranged in two columns, wherein two of the blower units are each mounted onto a respective one of the vertical supports in a position vertically between the control console and the endless belt, and wherein the other two blower units are each mounted in a position vertically higher than the control console.

8. The treadmill of claim 1, wherein the fan controller has a known fan controller frequency that corresponds to the air speed at the user position, wherein the speed controller has a known duty cycle that corresponds to the defined belt speed, and wherein the fan controller is calibrated to substantially synchronize the air speed at the user position with the defined belt speed based on a known relationship between the known duty cycle and the known fan controller frequency.

9. A method for controlling the speed of a fan on a treadmill, said method comprising the steps of:

providing a treadmill, wherein the treadmill comprises:

a deck designed to support a user at a user position, an endless belt having an upper surface that moves relative to the deck, a motor configured to drive motion of the endless belt at an adjustable belt speed, a speed controller configured to control the adjustable belt speed of the endless belt, a user interface control board configured to communicate with the speed controller to allow user control of the adjustable belt speed, a fan mounted onto the treadmill, wherein the fan is configured to direct an airflow at an air speed in a direction toward the user position, a speed control signal monitor, a fan controller in communication with the speed control signal monitor and with the fan;

reading a control signal with the speed control signal monitor, wherein the control signal corresponds to a defined belt speed, wherein the control signal is an input signal to the speed controller from the user interface control board or a feedback signal from the speed controller to the user interface control board, wherein the speed control signal monitor comprises a pass-through device configured to read the control signal passing between the speed controller and the user interface control board;

calibrating the fan controller, wherein the fan controller has a known fan controller frequency that corresponds to the air speed at the user position, wherein the speed controller has a known duty cycle that corresponds to the defined belt speed, and wherein the fan controller is calibrated to substantially synchronize the air speed at the user position with the defined belt speed based on a known relationship between the known duty cycle and the known fan controller frequency;

converting the control signal corresponding to the defined belt speed into an output signal from the fan controller to the fan based on the calibration of the fan controller; and using the fan controller to control the air speed by adjusting the rotational speed of the fan in response to the control signal read by the speed signal control monitor such that the air speed at the user position is substantially synchronized with the defined belt speed on a unit-to-unit basis.

10. The method of claim 9, wherein the fan controller is configured to automatically adjust the rotational speed of the fan in response to changes in the defined belt speed during use of the treadmill.

11. The method of claim 9, wherein the motor is housed within a motor bay and is positioned at one end of the endless belt, wherein the treadmill further comprises a control console positioned vertically higher than the motor bay, wherein the control console comprises a user interface that is operably connected to the user interface control board.

12. The method of claim 11, wherein the user interface control board is housed within the control console, wherein the speed controller is housed within the motor bay and is operably connected to the user interface control board by a mast cable that is disposed within a vertical support that attaches the control console to the deck, wherein the pass-through device is wired to the mast cable and configured to read the control signal passing between the speed controller and the user interface control board via the mast cable.

13. The method of claim 9, wherein the treadmill comprises a control console positioned vertically higher than the endless belt, wherein the fan is mounted in a position vertically between the control console and the endless belt.

14. The method of claim 13, wherein the treadmill further comprises a second fan mounted in a position vertically higher than the control console.

15. The method of claim 9, wherein the treadmill comprises a control console positioned vertically higher than the endless belt, wherein the control console is attached to the deck by two vertical supports disposed on opposite sides of the deck, wherein the fan comprises four blower units arranged in two columns, wherein two of the blower units are each mounted onto a respective one of the vertical supports in a position vertically between the control console and the endless belt, and wherein the other two blower units are each mounted in a position vertically higher than the control console.

16. A treadmill comprising:

a deck designed to support a user at a user position;

an endless belt having an upper surface that moves relative to the deck;

a motor configured to drive motion of the endless belt at an adjustable belt speed;

a speed controller configured to control the adjustable belt speed of the endless belt;

a fan mounted onto the treadmill, wherein the fan is configured to direct an airflow at an air speed in a direction toward the user position;

a belt speed sensor configured to directly measure a linear speed of the upper surface of the endless belt, wherein the linear speed of the upper surface of the endless belt is substantially synchronized with a defined belt speed on a unit-to-unit basis; and a fan controller in communication with the belt speed sensor and with the fan, wherein the fan controller is configured to control the air speed by adjusting a rotational speed of the fan in response to an input signal from the belt speed sensor such that the air speed at the user position is substantially synchronized with the defined belt speed on a unit-to-unit basis, wherein the input signal from the belt speed sensor corresponds to the defined belt speed.

17. The treadmill of claim 16, wherein the belt speed sensor is an optical or a mechanical speed sensor.

18. The treadmill of claim 16, wherein the fan controller is configured to automatically adjust the rotational speed of the fan in response to changes in the defined belt speed during use of the treadmill.

19. The treadmill of claim 16, wherein the treadmill comprises a control console positioned vertically higher than the endless belt, wherein the fan is mounted in a position vertically between the control console and the endless belt, wherein the treadmill further comprises a second fan mounted in a position vertically higher than the control console.

* * * * *